US006280012B1

(12) United States Patent
Schloeman et al.

(10) Patent No.: US 6,280,012 B1
(45) Date of Patent: Aug. 28, 2001

(54) PRINTHEAD APPARATUS HAVING DIGITAL DELAY ELEMENTS AND METHOD THEREFOR

(75) Inventors: Dennis J. Schloeman; Jeffery S Beck; Adam L Ghozeil, all of Corvallis, OR (US)

(73) Assignee: Hewlett-Packard Co., Palo Alto, CA (US)

( * ) Notice: Subject to any disclaimer, the term of this patent is extended or adjusted under 35 U.S.C. 154(b) by 0 days.

(21) Appl. No.: 09/416,597

(22) Filed: Oct. 12, 1999

Related U.S. Application Data

(63) Continuation-in-part of application No. 09/253,302, filed on Feb. 19, 1999.

(51) Int. Cl.[7] ..... B41J 2/045

(52) U.S. Cl. ..... 347/12; 347/9

(58) Field of Search ..... 347/9, 11, 12

(56) References Cited

U.S. PATENT DOCUMENTS 5,428,376 6/1995 Wade et al. ..... 347/14
5,508,724 4/1996 Boyd et al. ..... 347/58

*Primary Examiner*—Huan Tran

(57) ABSTRACT

Printhead and printer arrangements that provide digital delay between firing signals for a common firing interval. The delay achieves a controlled, staggered generation of firing signals that reduces EMI and instantaneous power supply draw and reduces or eliminates certain shielding requirements. Various arrangements are provided, including the use of edge triggered digital delay elements, staggered firing signal generation from firing signal control logic and the use of analog delay elements.

21 Claims, 3 Drawing Sheets

PRINTHEAD APPARATUS HAVING DIGITAL DELAY ELEMENTS AND METHOD THEREFOR

CROSS REFERENCE TO RELATED APPLICATION(S)

This application is a continuation-in-part of U.S. patent application Ser. No. 09/253,302, entitled REDUCED EMI PRINTHEAD APPARATUS AND METHOD, filed Feb. 19, 1999.

FIELD OF THE INVENTION

The present invention relates to improving performance in an ink jet printhead and, more specifically, to reducing EMI and the deleterious effects associated with EMI in an ink jet printhead.

BACKGROUND OF THE INVENTION

Many types of printers are known and they include ink jet, laser and various thermal and impact printers. Ink jet printers include those that are thermally actuated (e.g., resistive element) and those that are mechanically actuated (e.g., piezo-electric element). Representative ink jet printers include those made by Hewlett Packard, Canon and Epson, etc. The electromagnetic interference (EMI) reducing techniques of the present invention are applicable to all printers and particularly to ink jet printers.

Advances in semiconductor fabrication and printhead design have led to an increase in the number of firing chambers or drop generators provided on a printhead. In a representative prior art printhead each of the plurality of firing chambers or subset thereof, may be fired simultaneously.

An increase in the number of firing chambers on a printhead leads to an increase in printed image resolution and may result in improvements in image quality and the rate at which an image (or document) is printed.

While the ability to fire multiple printheads simultaneously is advantageous in delivering ink to a desired destination (e.g., a sheet of paper), multiple simultaneous firings are disadvantageous in that they generate a significant amount of EMI due to the multiple simultaneous firing signal transitions. In other words, the firing signal for each firing chamber may change from an off state to a drive state simultaneously (i.e., large current change ($\Delta i$) in a small time change ($\Delta t$)), causing the firing signal conductors to function as de-facto antenna that radiate electromagnetic interference generated by the abrupt signal transitions. Excess EMI causes interference with or the failure of system components and impedes receiving approval from the FCC and like international agencies that set EMI emission standards.

This problem is exacerbated by continuing efforts to increase firing chamber densities. Not only do higher density circuits have more EMI generation points, but they are also more likely to be adversely affected by the deleterious effects of EMI.

Current attempts to reduce or minimize the effects of EMI have relied primarily on shielding. This may take the form of shielded cables, grounded conductive coatings on the inside of plastic printer housings, ferrite beads placed around conductors and providing EMI generating and conducting components in a grounded sheet metal box or the like. These steps add significant expense to the cost of printers and complicate manufacture.

Another disadvantageous aspect of conventional printers is that simultaneous firing of multiple firing chambers results in a significant instantaneous draw on the power supply, resulting in the use of more expensive and larger power supplies and more frequent power supply failure.

SUMMARY OF THE INVENTION

Accordingly, it is an object of the present invention to provide a multiple firing chamber or drop generator ink jet printhead that modifies the timing of firing signals to reduce EMI and reduce power draw.

It is another object of the present invention to provide such an ink jet printhead that does not significantly increase system costs or impose system constraints.

It is also an object of the present invention to provide such a multiple firing chamber printhead in which the induced delays are sufficient to achieve nonsimultaneous firings, while not being long enough to adversely affect image quality.

It is also an object of the present invention to provide such a multiple firing chamber printhead that utilizes at least in part digital delay elements for modifying the timing of firing signals.

It is also an object of the present invention to provide a printer that incorporates such a printhead.

These and related objects of the present invention are achieved by use of a printhead apparatus having digital delay elements and method therefor as described herein.

The attainment of the foregoing and related advantages and features of the invention should be more readily apparent to those skilled in the art, after review of the following more detailed description of the invention taken together with the drawings.

DETAILED DESCRIPTION

Figure 1:
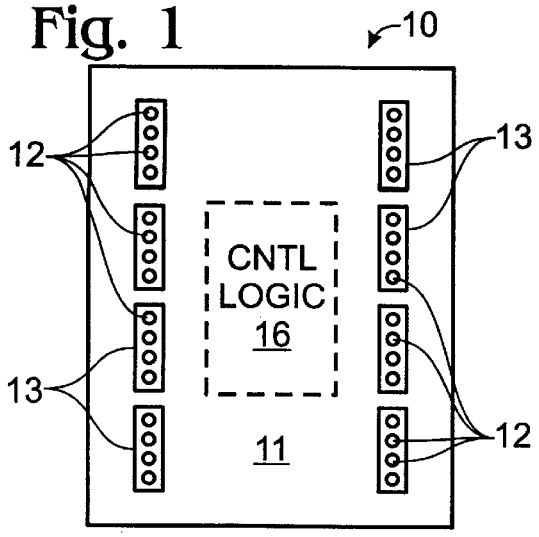
FIG. 1 is a top view of a printhead in accordance with the present invention.

Referring to FIG. 1, a top view of a printhead in accordance with the present invention is shown. Printhead 10 includes a substrate 11 on which a plurality of nozzles 12 are formed. Ink is preferably ejected through these nozzles onto a page or other printable surface. A firing chamber or drop generator (not shown in the perspective of FIG. 1) is preferably provided under each nozzle and each firing chamber can cause a drop or bubble of ink to be expelled through a nozzle. The nozzles (and their corresponding firing chambers) may be grouped in primitives 13 which are subsets of nozzles in which only one nozzle (or less than all nozzles) is fired per firing interval. While FIG. 1 illustrates four nozzles per primitive, more or less than this number may be provided. The use of primitives may decrease power consumption and lead interconnects and may address fluidic concerns.

Control logic 16 is shown in phantom lines to indicate that this control logic may be provided on or off (or in-part on or off) the die. In a preferred embodiment, the control logic is provided substantially on the printhead die and the firing signal generating logic, discussed below, is preferably provided in or coupled to the control logic.

Figure 2:
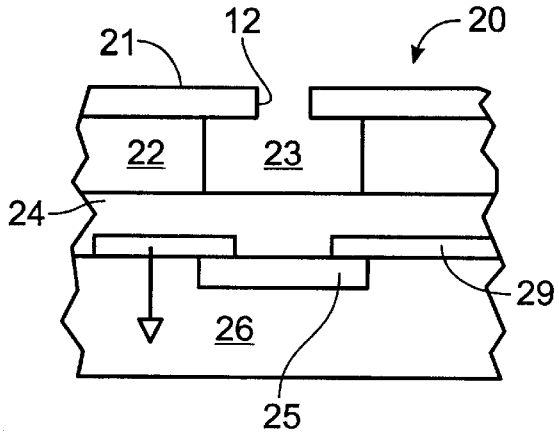
FIG. 2 is a cross-sectional view of a representative firing chamber or drop generator for use with the printhead of FIG. 1.

Referring to FIG. 2, a cross-sectional view of a representative firing chamber 20 for use with the printhead of FIG. 1 is shown. While FIG. 2 represents a thermal activated ink expulsion element (e.g., firing chamber), it should be recognized that mechanical (e.g., piezo-electric) or other types of ink expulsion elements could be utilized. The term ink expulsion element refers generally to a device (or collection of components) that cause a drop of ink to be expelled for printing purposes.

Firing chambers represent a type of ink expulsion element. Suitable firing chambers are known in the art and include firing chambers having different components and configurations than those shown in FIG. 2. Firing chamber 20 includes an orifice layer 21, in which nozzle 12 is formed, a barrier layer 22 that helps define ink well 23, a passivation layer (or like protection layer) 24 and an ink expulsion element 25 such as a resistor or mechanical actuator or the like. A firing signal is delivered to the expulsion element via conductive material 29. The above components are preferably formed on a semiconductive substrate 26.

Figure 3:
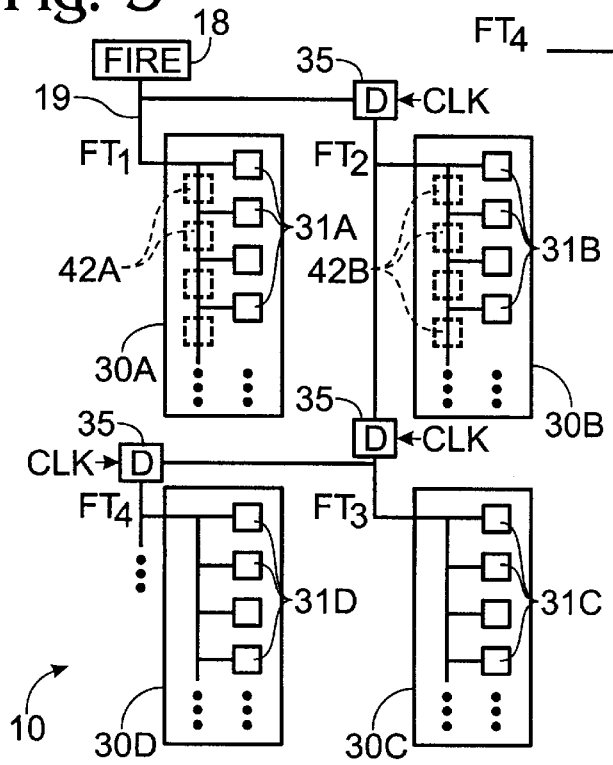
FIG. 3 is a schematic diagram of a printhead having digital delay elements for EMI reduction in accordance with the present invention.

Referring to FIG. 3, a schematic diagram of printhead 10 having digital delay elements for EMI reduction in accordance with the present invention is shown. A plurality of firing chambers or drop generators, i.e., ink expulsion elements, are provided. These firing chambers may be arranged individually or in primitives or in other groups. FIG. 3 illustrates a plurality of small squares 31A–31D that each represent either an individual firing chamber or a group of firing chambers such as a primitive or an otherwise arranged group of firing chambers. For purposes of the present discussion these will be termed drop generator items (DGIs).

In one embodiment, the plurality of DGIs are divided into larger groups termed drop generator groups (DGGs) 30A–30D and in the event that four of these larger groups are provided, these groups may be termed quadrants. It should be recognized, however, that while four DGGs are shown in FIG. 3, more or less than this number may be presented without departing from the present invention.

Firing signal generation logic 18 preferably generates a firing signal that is propagated by conductor 19 to DGGs 30A–30D. The firing signal, FT1, at the output of firing signal generation logic 18, is delayed by digital delay element (DDE) 35 at DGG 30B and then again at both DGGs 30C and 30D by other DDEs 35. DDEs 35 achieve a staggered and known timing relationship between the firing signal for the various DGGs. DDEs 35 also achieve a known timing relationship between delayed firing signals and other signals.

The sequential arrangement of DDEs 35 of FIG. 3 produces sequentially delayed firing signals FT2, FT3, FT4 that are in turn delivered to their corresponding DGGs. It should be recognized that the delayed firing signal arrangement need not be linear (as discussed in more detail below) and need not be limited to four DGGs.

Figure 5:
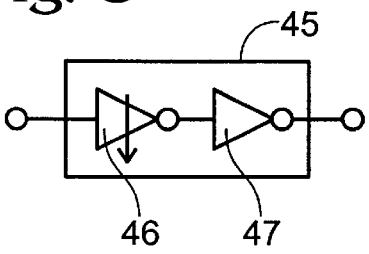
FIG. 5 is a schematic diagram of an analog delay element that is suitable for use in the printhead arrangement of FIG. 3 and other arrangements in accordance with the present invention.

If desired, additional delay elements may be provided between any of the DGIs 31A, 31B, 31C and/or 31D. Optional delay elements 42 are shown for DGGs 30A and 30B, though these elements may be provided for each DGG. Furthermore, these additional delay elements may be provided for each single, each pair, each triplet, etc., of DGIs, though one is shown for each single DGI in FIG. 3. Delay element 42 may be digital or analog. A suitable analog delay element with reference numeral 45 is shown in FIG. 5.

DDEs 35 are preferably flip-flops (FFs) and while they may be toggle, D, JK, SR or other, they are preferably D flip-flops for simplicity. As FFs, the input of DDEs 35 becomes the output upon the specified clock signal transition. These devices may be positive or negative-edge triggered as discussed herein. Latches (i.e., level-triggered devices) and other digital delay devices may also be suitable as digital delay elements and are within the ability of one skilled in the art to integrate into a printhead given the teachings herein. An advantage of digital delay elements over analog delay elements is that the amount and timing of delay induced by a digital delay element is more precise than that induced by an analog delay element which may vary with process variances.

While digital delay elements are preferred for the delay of element 35, it should be recognized that any combination of analog and digital delay elements is within the present invention. This may include providing analog devices for elements 35 and digital devices for elements 42, or any combination thereof.

Figure 4:
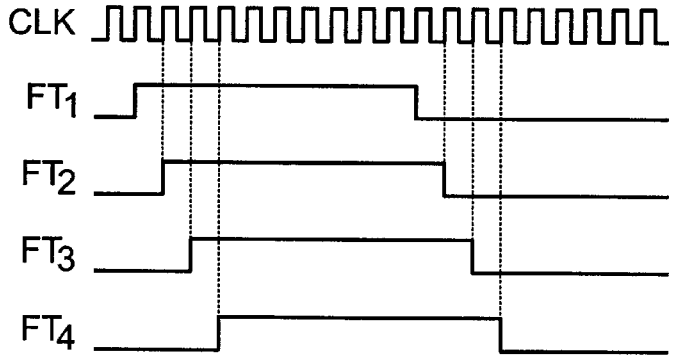
FIG. 4 is a timing diagram for the circuit of FIG. 3.

Referring to FIG. 4, a timing diagram for the circuit of FIG. 3 is shown. FIG. 4 illustrates that within a common firing interval, firing signals FT2–FT4 are preferably approximately one clock cycle behind their preceding firing signal.

Referring to FIG. 5, an analog delay element 45 that is suitable for use in the printhead arrangement of FIG. 3 and other arrangements in accordance with the present invention is shown. Analog delay element 45 (which may be used for delay element 42 of FIG. 3) preferably includes a first inverter 46 and a second inverter 47. The first inverter 46 preferably has weak fanout or drive capability and the second inverter 47 preferably has adequate fanout capabilities. As a weak inverter (low fanout), inverter 46 requires time (i.e., delay) to charge the input capacitance of the second inverter. The amount of delay can be determined by the drive strength of the first inverter. The second inverter also functions to correct the polarity of the signal output from the first inverter.

With respect to delay timing, a characteristic of delay elements 35,35' (discussed below),42 and 45 is that the delay element is preferably capable of generating a sufficiently short delay such that firing signals are staggered, but image quality is not adversely affected. The delay of elements 35,35',42,45 is preferably orders of magnitude less than the firing interval. For example, if the firing interval is in the microsecond range (0–999), then the induced delay is preferably in the nanosecond range (0–999). The digital delay device clock speeds are preferably in the range of 25 MHz or greater to achieve this level of performance.

Figure 6:
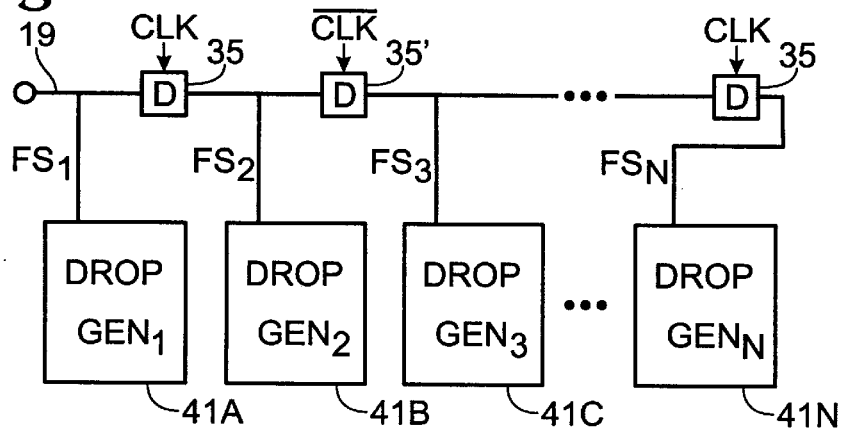
FIG. 6 is a schematic diagram of another firing signal delaying arrangement in accordance with the present invention.

Referring to FIG. 6, a schematic diagram of another firing signal delaying/staggering arrangement in accordance with the present invention is shown. FIG. 6 illustrates a digital delay element 35' that is clocked clocked by clock-bar. In a preferred embodiment of the arrangement of FIG. 6, delay elements are alternated along conductor 19 between positive and negative edge triggering 20 devices so that the delay induced at each delay device is reduced by approximately 50% over an arrangement of only positive or negative edge triggered devices.

Sequentially delayed firing signals FS1, FS2, FS3 and FSN are shown coupled to individual firing chambers or groups of firing signals, i.e., DGIs, indicated by reference numbers 41A–41N, respectively.

Figure 7:
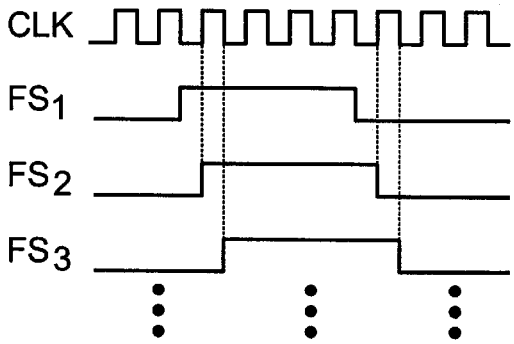
FIG. 7 is a timing diagram for the firing signal delay arrangement of FIG. 6.

Referring to FIG. 7, a timing diagram for the firing signal delay arrangement of FIG. 6 is shown. FIG. 7 illustrates that when FS1 transitions, FS2 makes a similar transition on the next rising edge of the clock signal and FS3 makes the same transition on the next falling edge of the clock signal.

Figure 8:
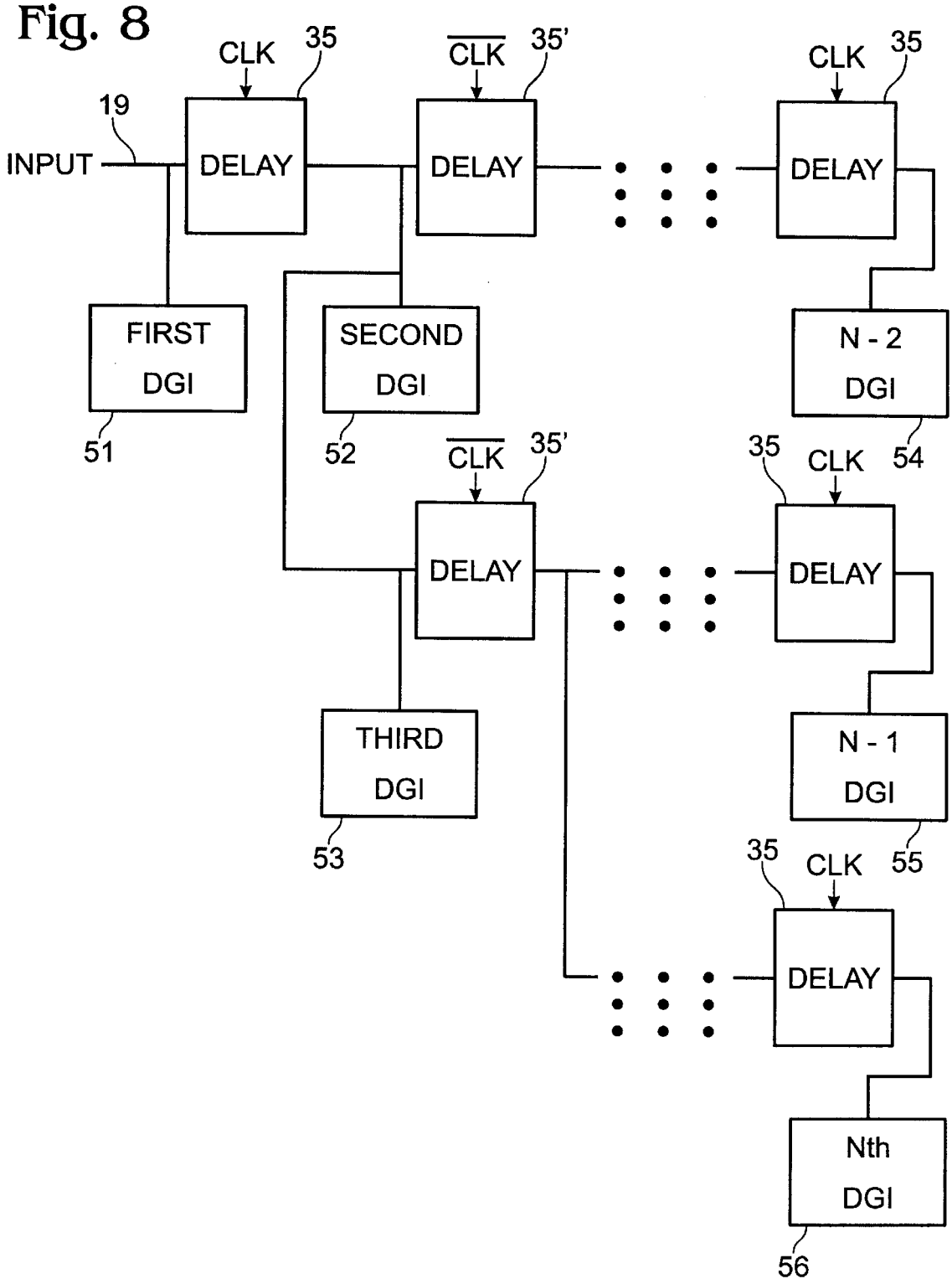
FIG. 8 is a schematic diagram of another firing signal delaying arrangement in accordance with the present invention.

Referring to FIG. 8, a schematic diagram of another firing signal delaying/staggering configuration in accordance with the present invention is shown. FIG. 8 illustrates a tree-like or branched signal conductor path 19 (utilizing clock and clock-bar signals) whereas FIG. 6, for example, illustrates a linear signal path.

A global or regional firing signal is preferably input to (1) a first DGI 51 (which may be either a single firing chamber or a group of firing chambers) and (2) a digital delay element (DDE) 35. The output of the first DDE is input to a second and third DGI 52, 53 and to second and third clock-bar actuated DDEs 35'. Note that non clock-bar DDEs could be used here. The output of DDEs 35' is delivered to a plurality of non clock-bar DDEs and this pattern of expansion or related patterns of expansion preferably continue until N–2, N–1 and N DGIs 54–56 are reached. These DGIs are fed by another DDE 35.

FIG. 8 is intended to illustrate that multiple DDE and DGI arrangements are possible and within the present invention. Firing signal propagation may be linear or branched. Delay devices may be positive or negative edge triggered (or level triggered, etc.). It should be recognized that analog delay devices may be substituted for some or even most of the digital delay elements or otherwise provided in the firing signal propagation path.

The circuitry of FIGS. 3, 5, 6 and 8 provides a controlled manner of staggering delivery of a firing signal to ink expulsion elements (e.g., firing chambers). Delivery is staggered in a manner that does not adversely affect image quality, yet achieves a significant reduction in EMI and along with it a reduction in the amount and type of costly shielding. The instantaneous demand on the power supply is also significantly reduced because the requisite power to the firing signals is spread out over a longer time period. This in turn eliminates or significantly reduces the large power spike created by the simultaneous transitions of multiple firing signals.

It should also be recognized that while the provision of delay elements in the firing signal conductor or distribution path achieves a desired staggering of firing signal delivery, the firing signals may also be staggered in whole or in part directly from the firing signal control logic 16, 18. Suitable control logic. (e.g., microprocessor or programmable gate array, etc.) is known and may be utilized to generate multiple firing signals that are staggered in time. These firing signals may be fed directly to DGIs and/or DGGs or be routed in whole or in part through delay elements (35, 35', 42, 45).

Figure 9:
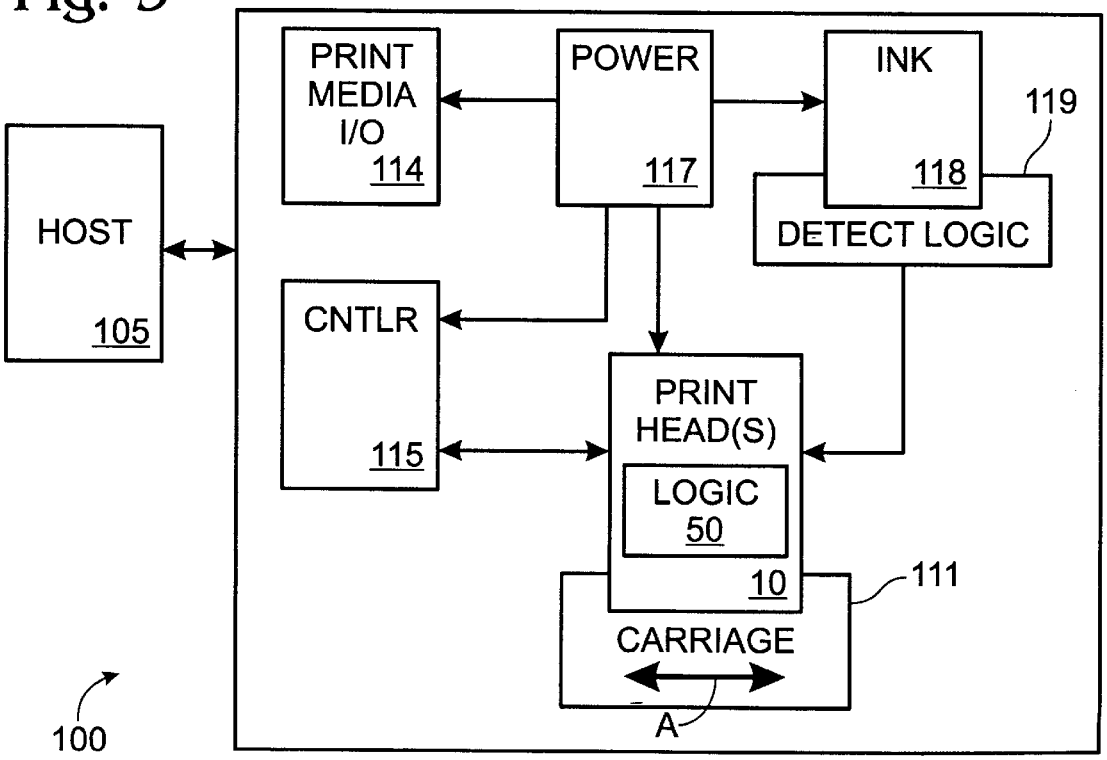
FIG. 9 is a schematic diagram of a printer incorporating a printhead with staggered firing signal delivery in accordance with the present invention.

Referring to FIG. 9, a schematic diagram of a printing system 100 that incorporates printhead 10 (having staggered/delayed firing signal delivery) in accordance with the present invention is shown. Printer system 100 includes a host machine 105 that is coupled to a printer 108. The host machine may be a computer, facsimile machine, Internet terminal or other print data generating device.

Printer 108 preferably includes printhead 10 which is preferably mounted on a carriage 111. Carriage 111 provides movement of the printhead across print media. Two headed arrow A indicates transverse movement of printhead 10. While carriages are often provided for printhead movement, printhead can also be made that are as wide as the medium to be printed and therefor movement of the printhead is not required.

Printhead 10 is coupled to a controller 115 that provides processing signals. Controller 115 is coupled to host machine 105 and may be coupled to other printer components, for example, to indicate ink or paper out conditions, etc., to the host. Suitable carriage and controller configurations are known in the art.

Printer 108 also includes an ink supply 118. Ink supply 118 may be formed integrally with printhead 10 or formed separately. Ink supply 118 may be provided in a refillable or replaceable manner. Ink level detection logic 119 is preferably provided with ink supply 118.

Printer 108 also preferably includes a print media input/output (I/O) unit 114. Print media may include paper, Mylar and any other material onto which printhead 10 may expel ink. Print media I/O unit 114 preferably provides a receptacle for pre-printed and post-printed media and a mechanism for transport of print media between these two receptacles. Power supply 117 delivers appropriate power to the printhead, controller, ink supply (and ink level detection logic) and the print media I/O unit.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. A printhead apparatus, comprising:

a substrate;

a plurality of ink expulsion elements formed on said substrate and arranged in at least a first group and a second group;

a firing signal conductor coupled to each of said ink expulsion elements; and a digital delay element provided in said firing signal conductor between said first and said second groups of ink expulsion elements that within a common firing interval achieves a delay in the receipt of a firing signal at said second group relative to said first group.

2. The printhead apparatus of claim 1, wherein said delay achieves a reduction in EMI, but is not of sufficient duration to affect image quality.

3. The printhead apparatus of claim 1, wherein said digital delay device is edge-triggered.

4. The printhead apparatus of claim 3, further comprising a second digital delay element and wherein said one of said delay elements is rising edge triggered and the other is falling edge triggered.

5. The printhead apparatus of claim 3, wherein said digital delay device is a flip-flop.

6. The printhead apparatus of claim 1, further comprising an analog delay device between said at least two of said ink expulsion elements.

7. The printhead apparatus of claim 1, further comprising additional digital delay elements provided between ink expulsion elements.

8. The printhead apparatus of claim 1, further comprising more than two groups of ink expulsion elements and providing digital delay elements between each group of ink expulsion elements.

9. The printhead apparatus of claim 1, further comprising at least one of the group of elements including:

a printer controller;

a print media I/O unit;

an ink supply;

a power supply; and a movable printhead carriage.

10. A printhead apparatus, comprising:

a substrate;

a plurality of ink expulsion elements formed on said substrate;

a firing signal conductor coupled to each of said ink expulsion elements; and a mechanism coupled to said firing signal conductor for inducing within a common firing interval a digital delay between receipt of a firing signal at one of said ink expulsion elements relative to the receipt of that firing signal at another of said ink expulsion elements to reduce EMI.

11. The printhead apparatus of claim 10, wherein said mechanism includes control logic that creates multiple firing signals within a common firing interval that are delayed relative to one another.

12. The printhead apparatus of claim 10, wherein said mechanism includes a digital delay element provided in said firing signal conductor between two of said ink expulsion elements.

13. The printhead apparatus of claim 10, wherein said ink expulsion elements are provided in a plurality of groups and said digital delay mechanism includes a plurality of digital delay elements provided between each group of ink expulsion elements.

14. The printhead apparatus of claim 13, further comprising an analog delay device provided between two of said ink expulsion elements.

15. The printhead apparatus of claim 12, wherein said digital delay element is edge triggered.

16. The printhead apparatus of claim 10, including digital delay elements, some of which are positive edge triggered and some of which are negative edge triggered.

17. The printhead apparatus of claim 10, wherein said firing signal conductor is branched.

18. The apparatus of claim 10, further comprising at least one of the group of elements including:

a printer controller;

a print media I/O unit;

an ink supply;

a power supply; and a movable printhead carriage.

19. A method of mechanized printing, comprising the steps of:

providing a printhead having multiple ink expulsion elements;

generating firing signals for said ink expulsion elements; and producing said firing signals such that within a common firing interval at least some of said firing signal are digitally delaying relative to other firing signals.

20. The method of claim 19, further comprising the step of inducing said digital delay with digital delay elements.

21. The method of claim 19, further comprising the step of inducing an analog delay between firing signals within a common firing interval.

* * * * *